US005745991A

United States Patent [19]

Soriano

[11] Patent Number: 5,745,991

[45] Date of Patent: May 5, 1998

[54] MACHINE AND METHOD FOR PRODUCING ELECTRICAL HARNESS

[75] Inventor: Louis Soriano, Aubagne, France

[73] Assignee: The Whitaker Corporation, Wilmington, Del.

[21] Appl. No.: 750,157

[22] PCT Filed: Jun. 13, 1995

[86] PCT No.: PCT/IB95/00479

§ 371 Date: Nov. 27, 1996

§ 102(e) Date: Nov. 27, 1996

[87] PCT Pub. No.: WO95/34926

PCT Pub. Date: Dec. 21, 1995

[30] Foreign Application Priority Data

Jun. 15, 1994 [FR] France ..... 94 07682

[51] Int. Cl.[6] ..... H01R 43/04

[52] U.S. Cl. ..... 29/863; 29/755; 29/749; 29/3 M; 156/433

[58] Field of Search ..... 29/861, 863, 759, 29/755, 33 M, 564.4, 749; 156/433

[56] References Cited

U.S. PATENT DOCUMENTS

| | | | |
|---|---|---|---|
| 4,581,796 | 4/1986 | Fukuda et al. | 29/564.4 X |
| 5,083,369 | 1/1992 | Cerda | 29/861 X |
| 5,083,370 | 1/1992 | Koeh et al. | 29/863 |
| 5,127,159 | 7/1992 | Kudo et al. | 29/863 |
| 5,208,977 | 5/1993 | Ricard | 29/861 |
| 5,365,659 | 11/1994 | Ueda et al. | 29/863 |
| 5,404,634 | 4/1995 | Takeshita et al. | 29/564.4 |
| 5,606,795 | 3/1997 | Ohba et al. | 29/863 |
| 5,611,174 | 3/1997 | Takada et al. | 29/861 |

FOREIGN PATENT DOCUMENTS

| | | | |
|---|---|---|---|
| 0 167 985-A3 | 1/1986 | European Pat. Off. | H01R 43/26 |
| 0 292 297-A3 | 11/1988 | European Pat. Off. | H01R 43/20 |

*Primary Examiner*—Carl J. Arbes

[57] ABSTRACT

The invention relates to a machine for producing electrical harnesses. The machine comprises: a rectilinear main conveyor (1) suitable for moving clamps (2) for transferring the ends (4, 5) of lengths (3) of wire; a bench (9); and a station (6) for loading lengths (3) of wire and situated on a first side of the main conveyor, while the loop-forming portions (3*a*) of said lengths of wire are situated on a second side of the main conveyor. The machine also includes a fixed rectilinear transverse slideway (13) orthogonal to the main conveyor and forming a support for guiding components (18, 19, 20, 21) in translation. The machine further includes a device for moving and positioning components on the slideway, and a clamp (40) for inserting the ends of the lengths of wire, which clamp is mounted on a support that is movable in rotation and in translation relative to an axis (YY) that is orthogonal to the main conveyor and to the slideway. The technical field of the invention is that of machines and methods for producing electrical harnesses.

10 Claims, 6 Drawing Sheets

MACHINE AND METHOD FOR PRODUCING ELECTRICAL HARNESS

BACKGROUND OF THE INVENTION

1. Field of the Invention

The present invention relates to a machine for producing electrical harnesses, the machine making it possible to produce such harnesses automatically from components (or connectors) and electric wire.

The technical field of the invention is that of machines and methods for producing electrical harnesses.

2. Summary of the Prior Art

An apparatus for producing electrical harnesses is already known from application PCT/FR91/01020 (WO 92/12614) in which the harnesses include wires whose ends are inserted in cavities of the components, the apparatus including a main conveyor for transporting wires and a secondary conveyor for transporting transfer trays, each tray receiving one or more components, a station situated along the secondary conveyor for automatically loading components on the transfer trays, and means for transferring the transfer trays from the secondary conveyor to the main conveyor. The apparatus includes a transfer support capable of displacing the transfer trays, and consequently the components, relative to an insertion clamp, so as to enable the ends of lengths of wire to be inserted successively into the cavities of the components.

The apparatus is particularly intended for producing very complex harnesses fitted with connectors having a large number of cavities disposed in arrays, i.e. as a plurality of juxtaposed rows or columns, and is relatively complex and expensive.

SUMMARY OF THE INVENTION

One of the objects of the invention is to provide apparatus enabling wire ends to be inserted in the cavities of components that are simple, i.e. components that have a single row of cavities or components that have a plurality of rows, but in which only one row is to be used; this applies in particular when producing electrical harnesses fitted with "insulation-displacement" components. Such components usually include, at least one pair of blades disposed facing each other within a cavity for receiving wire end between them so that the insulation covering is cut by the blades to establish electrical contact between the conducting core of the electric wire and the connection of said cavity via said blades which are made of electrically conductive material.

One of the objects of the invention is also to provide a module for producing electrical harnesses including connectors that are simple, the module being suitable for insertion in a machine for manufacturing harnesses that are more complex, e.g. a machine such as that described in the above-mentioned international application.

As explained in international application PCT/FR92/00896 (WO 92/10013), it should be observed that, prior to the operation of inserting wire ends into the cavities of components, the use of machines as described in the first above-mentioned application generally requires the ends of lengths of wire which are delivered by known wire length preparation means to be organized in such a manner as to make it possible subsequently to place the wire length ends in an order that is close to or identical to the order in which the ends are to be inserted, which order is different from the order in which the wire length ends are delivered by the preparation machines. This organization requires the use of a special module that is bulky, expensive, and relatively slow.

The solution to the problem posed consists in providing a machine for producing electrical harnesses, the machine comprising: a rectilinear main conveyor suitable for moving transfer clamps for transferring the ends of lengths of wire; a bench; and a loading station for loading and preparing lengths of wire; the loading station being situated on a first side of said main conveyor, the loop-forming portions of said lengths of wire being situated on a second side of said main conveyor, the machine including a fixed rectilinear transverse slideway substantially orthogonal to said main conveyor, where the slideway forms a member for supporting components and for guiding them in translation, each of said components being provided with a row of cavities, said machine including a device for moving and positioning said components on said slideway, and said machine including a clamp for grasping and inserting the ends of said lengths of wire, the clamp being mounted on a support that is movable in rotation about and translation along an axis orthogonal to said main conveyor and to said slideway, and is situated on said second side of said main conveyor.

In a preferred embodiment, the invention provides a machine for producing electrical harnesses that comprises a longitudinal, rectilinear main conveyor belt or chain having a longitudinal axis that is preferably horizontal, which main conveyor is suitable for moving main or transfer clamps each of which is suitable for holding (preferably in a horizontal position) one of the two ends of a length of electrically conductive wire; said machine includes a bench that supports a loading station for loading and preparing lengths of wire, and, where appropriate, supporting stations for preparing the ends of said lengths of wire, which bench extends along the entire length of said main conveyor; which bench, which length preparation station, and, where appropriate, which stations for preparing the ends of lengths of wire are all situated on a first side of said main conveyor and/or of a vertical plane containing the longitudinal axis of said main conveyor, the loop-forming portions of said lengths of wire being situated on a second side of said conveyor and/or said plane; the machine further including a rectilinear transverse slideway that is fixed relative to said bench and whose longitudinal axis is substantially orthogonal to said axis of said main conveyor, which slideway forms a support and a part for guiding components (or connectors) in translation, each being provided with a row of regularly-spaced apart cavities; said machine further including a displacement device for displacing and positioning said components on said slideway, at least in an "insertion" zone or portion of said slideway, which displacement device co-operates with the bodies of said components; said machine further includes at least one insertion clamp for grasping the ends of said lengths of wire, for extracting them from said transfer clamps, and for inserting them in the cavities, which insertion clamp is mounted on a support that is movable in rotation and translation relative to an axis that is orthogonal both to said longitudinal axis of sad main conveyor and to said longitudinal axis of said slideway, which axis of said insertion clamp is preferably vertical and situated on said second side of said main conveyor, preferably at a small distance both from said slideway and from said main conveyor.

In preferred embodiments:

said rectilinear fixed transverse slideway is provided with a channel of a section whose profile is complementary in shape to the profile of a portion of the section of the bodies of said components;

said slideway extends from one side to the other of said main conveyor and/or said longitudinal axis of said conveyor;

the machine further includes removable magazines, preferably constituted by lengths of section bar having a section that is similar to that of said slideway, which lengths are disposed upstream from the slideway and have their longitudinal axes extending in a (preferably horizontal) plane containing the axis of said slideway, being parallel to said longitudinal axis of said slideway, and said machine further includes a selector device suitable for causing said magazines to move along an axis orthogonal to said longitudinal axis of said slideway so as to bring one of said magazines substantially into alignment (in plan view) with said slideway so as to enable components stored (in a line or queue) on said magazines to pass onto said slideway; it being possible to feed said slideway with components under gravity by having said magazines sloping downwards a little in the downstream direction (relative to the advance direction of said components on said slideway);

said device for displacing and positioning the components may include a toothed wheel driven by a motor and suitable for meshing with teeth or non-uniformities provided on a face (or portion) of the bodies of said components, thereby ensuring that said components are accurately positioned and advanced in said insertion zone of said slideway, or of any equivalent means such as a comb that is movable, for example, in translation along a direction parallel to the longitudinal axis of said slideway;

said slideway may include or may be essentially constituted by a conveyor belt or chain;

said main conveyor and said slideway are preferably substantially horizontal, said slideway being disposed above said main conveyor so that its longitudinal axis is at a small distance from the longitudinal axis of said main conveyor;

the machine of the invention may include a first slideway, e.g. situated downstream from said insertion clamp support, and it may include a second slideway preferably substantially parallel to said first slideway and disposed upstream from said insertion clamp support, for example; and said insertion clamp support may also include means for displacing said insertion clamp in a direction perpendicular to the axis of said slideway, i.e. in a direction that is substantially parallel to the axis of said main conveyor, thereby enabling the ends of lengths of wire that are fitted with terminals to be inserted into corresponding cavities of connectors (connectors that are not insulation displacement connectors).

According to the invention, the machine of the invention for producing electrical harnesses is used, by performing the following operations:

a type of wire is selected and paid out from a spool selected from a plurality of electric wire storage spools;

a determined length of said selected wire is cut off to constitute a length of wire;

said length is placed in such a manner that its two ends are held by two adjacent or successive transfer clamps of said main conveyor, the central or middle portion of said length being situated on a second side of said main conveyor and hanging from said ends that are held by said clamps;

said main conveyor is displaced in such a manner as to cause said transfer clamps to move in an advance direction while holding the wire ends;

where appropriate, as said wire ends held by said transfer clamps move past an end-processing station, a treatment operation is performed on said ends, e.g. a terminal is crimped on said end or said end is stripped;

at least one end of a wire length is extracted and grasped using an extraction-insertion clamp which is mounted to move in rotation and translation relative to an axis which is orthogonal both to the longitudinal axis of said conveyor and to the longitudinal axis of said slideway, and which is preferably vertical;

said insertion clamp is displaced (in rotation) in such a manner as to cause said end held by said insertion clamp to face a cavity in a component situated on said slideway in said insertion zone; and said insertion clamp is caused to perform a vertical movement (preferably downwards) to cause the end held by said insertion clamp to be inserted into an insulation displacement component, or else to perform vertical downwards movement followed by translation movement in another direction when the component is conventional (i.e. not an insulation displacement component).

The invention makes it possible to provide machines for producing electrical harnesses of a particular structure, which machines are very simple and cheap to manufacture, while nevertheless providing performance that is most advantageous with respect to flexibility of use and the diversity of harness configurations that can be made; such machines are also very fast.

Because of the speed that is specific to operation of a machine of this type, the invention also provides insertion modules that can be integrated in machines that are more complex, e.g. machines of the kind described in the above-mentioned international applications, thereby making it possible to optimize overall profitability of a machine of that type. In machines that are capable of making harnesses that are very complex, i.e. machines of the kind described in the above-mentioned international applications, the cycle time of the downstream portion of the machine, i.e. the portion that organizes and inserts wire ends into components that are very complex, is much greater than the cycle time or preparation processing time required for the ends of the lengths of wire in the upstream portion of the machine, thereby causing the upstream portion of the machine to be under-used. Thus, by including an insertion station of the invention, it is possible to optimize profitability and utilization rate of the upstream portion that serves to prepare lengths of wire and to prepare their ends.

The numerous advantages provided by the invention will be better understood from the following description which refers to the accompanying drawings that show particular embodiments of the machine of the invention, without the invention being limited in any way thereto.

DETAILED DESCRIPTION OF THE PREFERRED EMBODIMENT

Where appropriate, in the present application, the terms "upstream" and "downstream" are relative to the advance direction of said transfer clamps and/or of said main conveyor, or of said components on said slideway.

Figure 1:
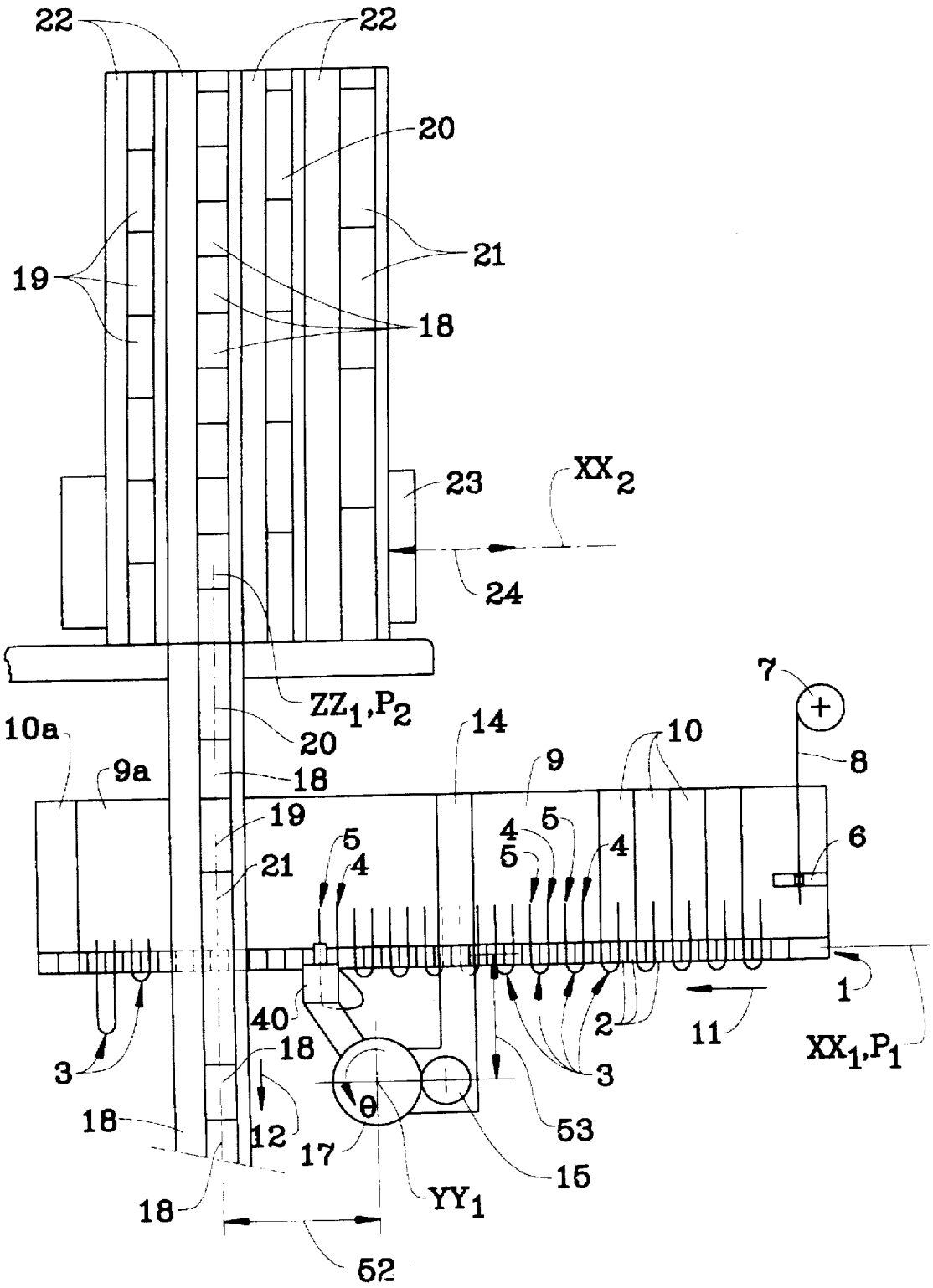
FIG. 1 is a diagrammatic plan view showing the main parts of a machine for producing electrical harnesses of the invention.
Figure 2:
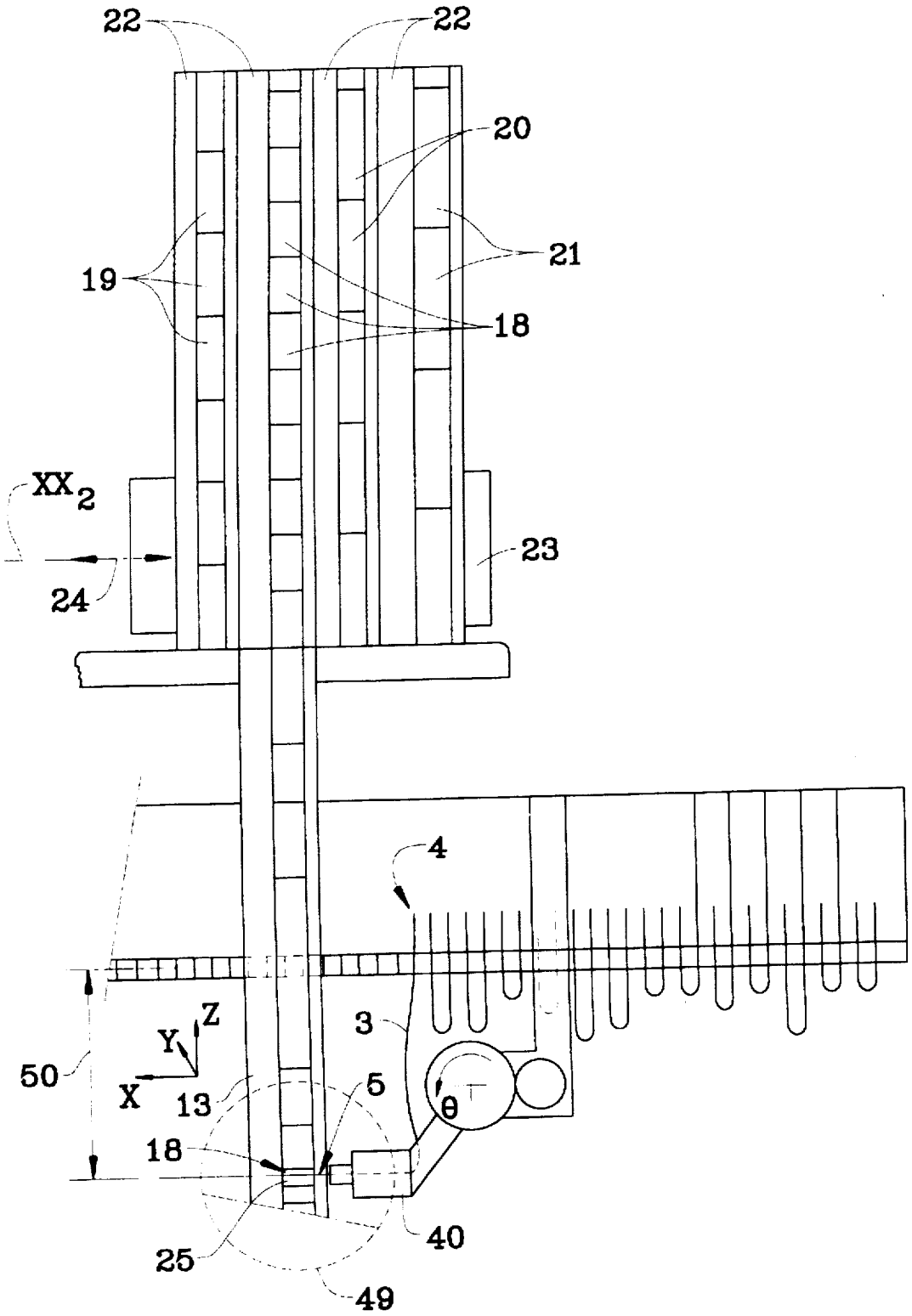
FIG. 2 is a plan view of the same machine as shown in FIG. 1, but with the insertion and extraction tool (clamp and moving support for the clamp) in a different position.

With reference mostly to FIGS. 1 and 2, a machine of the invention for producing harnesses comprises a main conveyor 1, such as a conveyor belt or chain which is suitable for displacing "transfer" clamps 2 in the direction marked by arrow 11 that extends parallel to the longitudinal axis XX1 of said main conveyor, each clamp being suitable for holding an end 4 or 5 of a length of wire 3, two clamps that are adjacent or disposed one after the other on said main conveyor 1 holding the two ends 4 and 5 of one of said lengths 3, the central or middle portions (referenced 3*a*, FIG. 4) being situated on the same side of said main conveyor 1, which side is referred to the in the present case as being the "second" side and is near the bottom of FIGS. 1 and 2, while said ends are situated on the same side of said conveyor, and in the present case on the "first" side thereof, i.e. the side nearer the top of FIGS. 1 and 2.

The lengths of wire 3 are taken from wire 8 that is wound on spools 7, the wire being cut to the desired lengths by a device 6 placed at the upstream end of the machine, e.g. the device described in patent application FR 2 669 613.

On a first side of said main conveyor 1, i.e. on a first side of said longitudinal axis XX1 of the conveyor, or in other words of a vertical plane P1 containing said axis XX1, there are disposed, on a support bench 9 forming the main structure of said machine as a whole, devices or stations 10 for processing the ends of said lengths of wire as said lengths are moved by said transfer clamps 2 which are themselves moved by said conveyor 1.

Such stations for processing ends serve, for example, to perform operations such as crimping terminals on the ends of the lengths of wire and/or stripping said ends; such end-processing stations are necessary when the machine is not intended solely for producing wire harnesses that have insulation-displacement connectors only; otherwise such stations or devices are not necessary.

Downstream from said station for preparing the ends of said lengths of wire, there are to be found firstly a support 14 in the form of a bracket fixed on said bench 9 and extending over said main conveyor 1, and carrying, at its end situated at the second side of said main conveyor, an insertion tool that includes an insertion and extraction clamp 40.

Downstream from this device, there is provided a slideway 13, i.e. a part that constitutes a support for components 18, 19, 20, and 21 and that also acts to guide said components as they are being moved in translation or advanced in the direction of arrow 12, i.e. longitudinally along an axis ZZ1 which is preferably horizontal and along which said slideway 13 extends.

Figure 4:
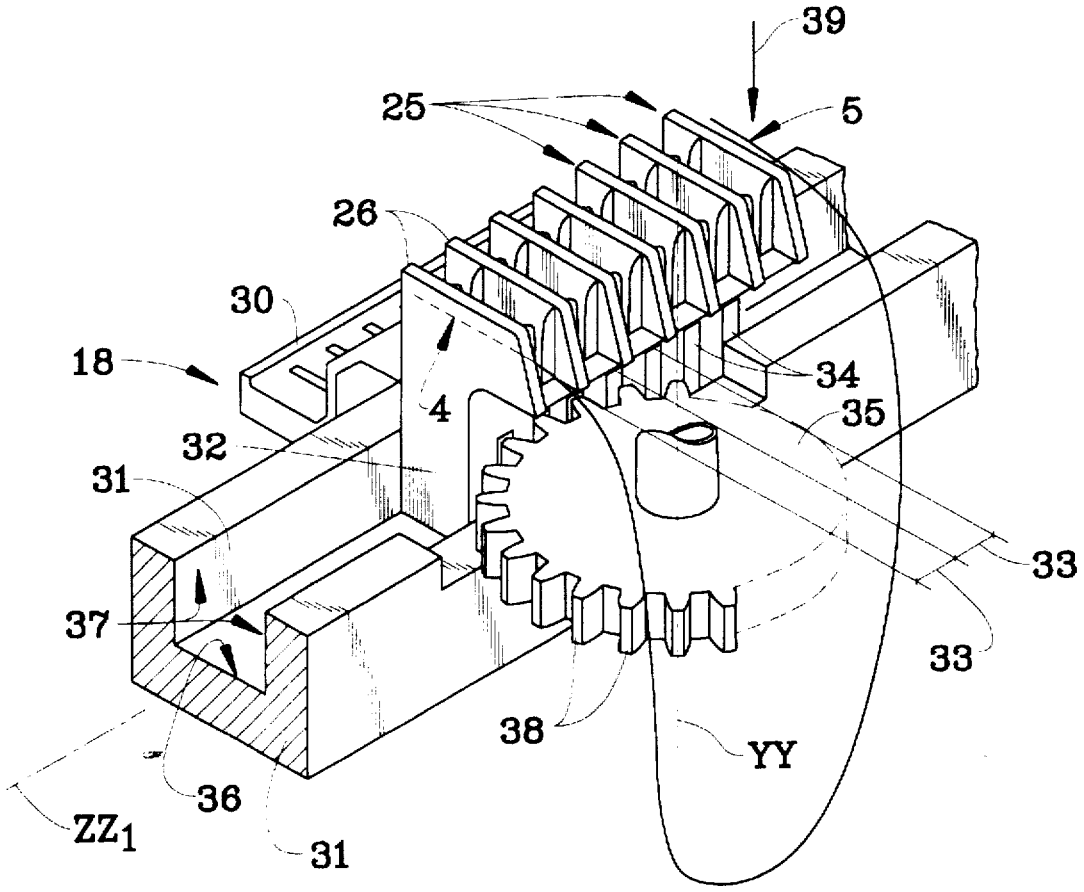
FIG. 4 is a fragmentary perspective view on a larger scale of the portion of the slideway that is situated in the insertion zone, together with the means for driving and positioning components in the slideway.

It is advantageous for the slideway to be constituted essentially by a section bar as shown in FIG. 4; nevertheless, it is also possible to provide a slideway that is more sophisticated, being constituted by (or including) a conveyor of structure that is similar to the main conveyor 1.

Downstream from said slideway 13 (relative to the general advance direction of the main conveyor 1 as indicated by arrow 11), it is possible to provide other workstations 10*a* on a portion 9*a* of said bench, which stations serve to preform operations involved in producing electrical harnesses that are more complex by using other devices (not shown) such as those described in the above-specified international applications. To this end, the transfer clamps carrying the lengths of wire 3 for use in such production may pass beneath said slideway 13 so as to position said lengths of wire in front of said stations 10*a*.

As shown in FIGS. 1 and 2, it can be seen that said slideway 13 may be fed with connectors 18, 19, 20, and 21 of different structures; all of the connectors are simple connectors, i.e. they have only one row of cavities each, but by way of example, the connectors 18 and 19 may be connectors belonging to the same family but differing in length, for example, in the number of cavities that they include; the connectors 20 and 21 may be of a different type, both belonging to a second family, and likewise differing in length, as shown in the figures.

The term "family" as applied to components designates components of corresponding or identical shape (in particular with respect to section in a plane perpendicular to the axis along which the cavities of the component are disposed); within a given family, components generally differ in length and/or number of cavities, and by having male or female type terminations.

In the top portions of FIGS. 1 and 2, it can be seen that connectors of the same type can be initially stored or loaded on removable supports 22 referred to as "magazines" which are essentially constituted, for example, by removable lengths of section bar having a structure that is similar to that of the slideway and that act as storage supports for said components, each magazine 22 receiving components that are identical. The magazines 22 disposed side by side and they extend parallel to one another. They may slope so as to feed said slideway 13 with components merely under gravity, the components sliding inside grooves provided in the magazines. The bank of such magazines 22 is preferably movable along an axis XX2 parallel to said axis XX1 and in both directions marked by arrow 24, under drive from a device 23 that includes a pusher and that acts as a connector selector. As shown in FIGS. 1 and 2 where the second magazine 22 (counting from the left of the figure) is placed in alignment with said slideway 13, the selector makes it possible in this position to feed said slideway with components 18 that are situated on the corresponding magazine. By moving the bank of magazines in translation along the axis XX2, the selector can subsequently bring one of the other magazines into alignment with the slideway 13 for the purpose of feeding said components 19, or 20, or 21.

Figure 3:
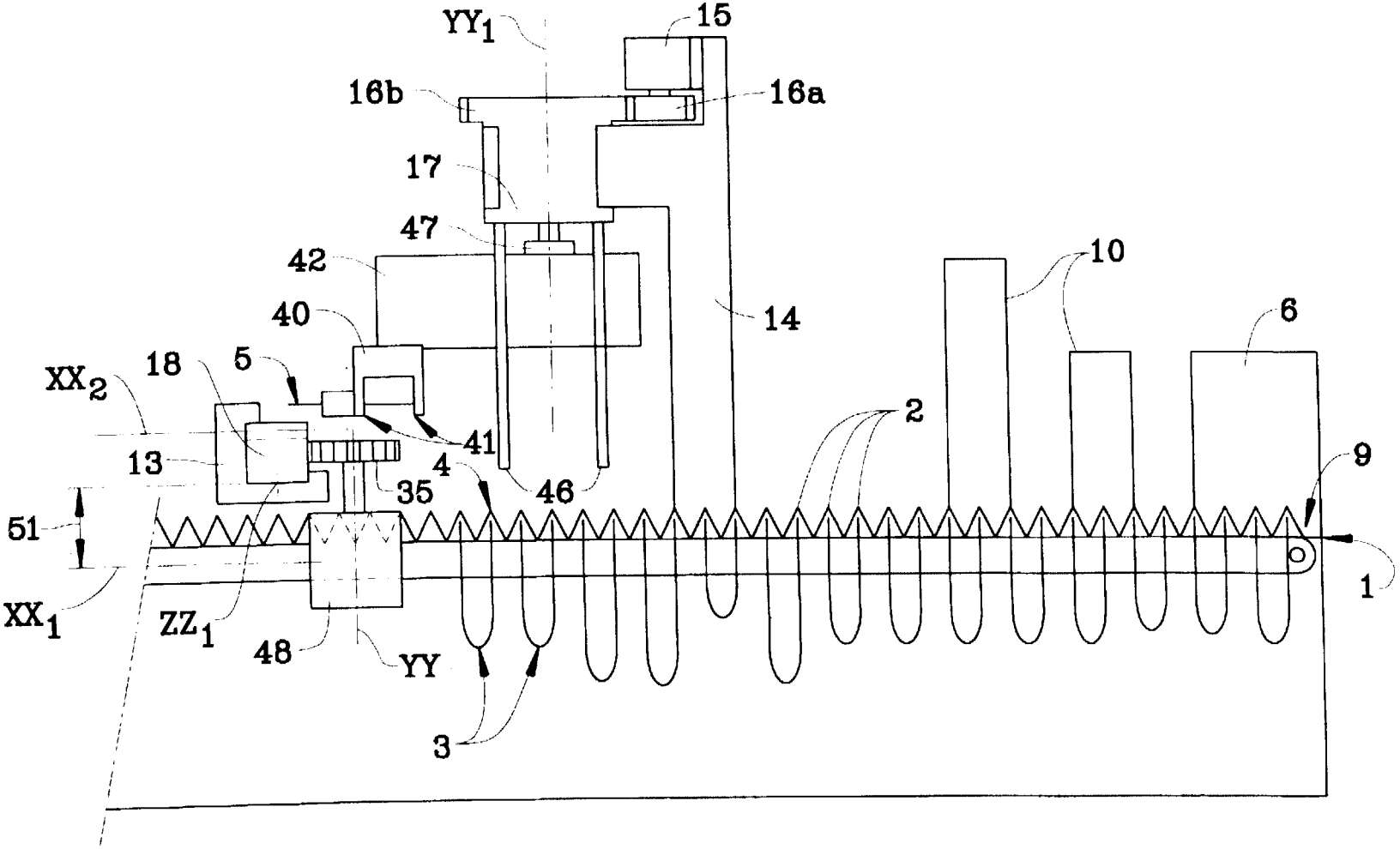
FIG. 3 is a diagrammatic side view of the machine shown in FIGS. 1 and 2, the insertion tool being in the same position as in FIG. 2.

As shown in FIGS. 1 to 3, the insertion tool situated at the top end of said bracket 14 essentially comprises a support 17 that is rotatable about an axis YY1 which is preferably vertical and orthogonal to said axes XX1 and ZZ1 along which said main conveyor and said slideway extend. The support 17 may be rotated by a motor 15 via gears 16*a* and 16*b* provided respectively on the shaft of said motor 15 and on said moving support 17.

As shown in FIG. 3, a support 42 may be mounted beneath said moving support 17 while remaining suitable for moving vertically relative to said support 17 by means firstly of an actuator 47 driving said support 42 in displacement relative to said support 17, and also because of guide elements 46 such as ball sockets or guide rails, for example.

It can also be seen in this figure that said support 42, which is movable in translation along the vertical axis YY1 and in rotation about the same axis, carries a clamp 40 which is used for extracting one end of a length of wire in the position shown in FIG. 1, and which is used for inserting said end 5 of the length of wire 3 in the position shown in FIGS. 2 and 3.

The extraction operation may be performed by said clamp 40 whose jaws 41 (FIG. 6) hold the end of the wire on either side of the end portion held by the transfer clamp 2 which is placed on said main conveyor 1.

It can be seen (in FIGS. 6 and 7) that said clamp 40 includes a body 43 fitted at the bottom with said jaws or teeth 41 for holding the wire end, and also includes at its end that is to the left in FIG. 6, a head or punch 44 whose bottom portion is fitted with grooves 45 (or notches of profile that is complementary to the profile of the blades provided in the cavities of the components) for a purpose that is explained below with reference to FIG. 7 when inserting said end into an insulation-displacement component. Said punch 44 is situated in line with the axis (ZZ, FIG. 6) on which the end of said length of wire is grasped, immediately above the terminal portion of the end of the length.

Figure 6:
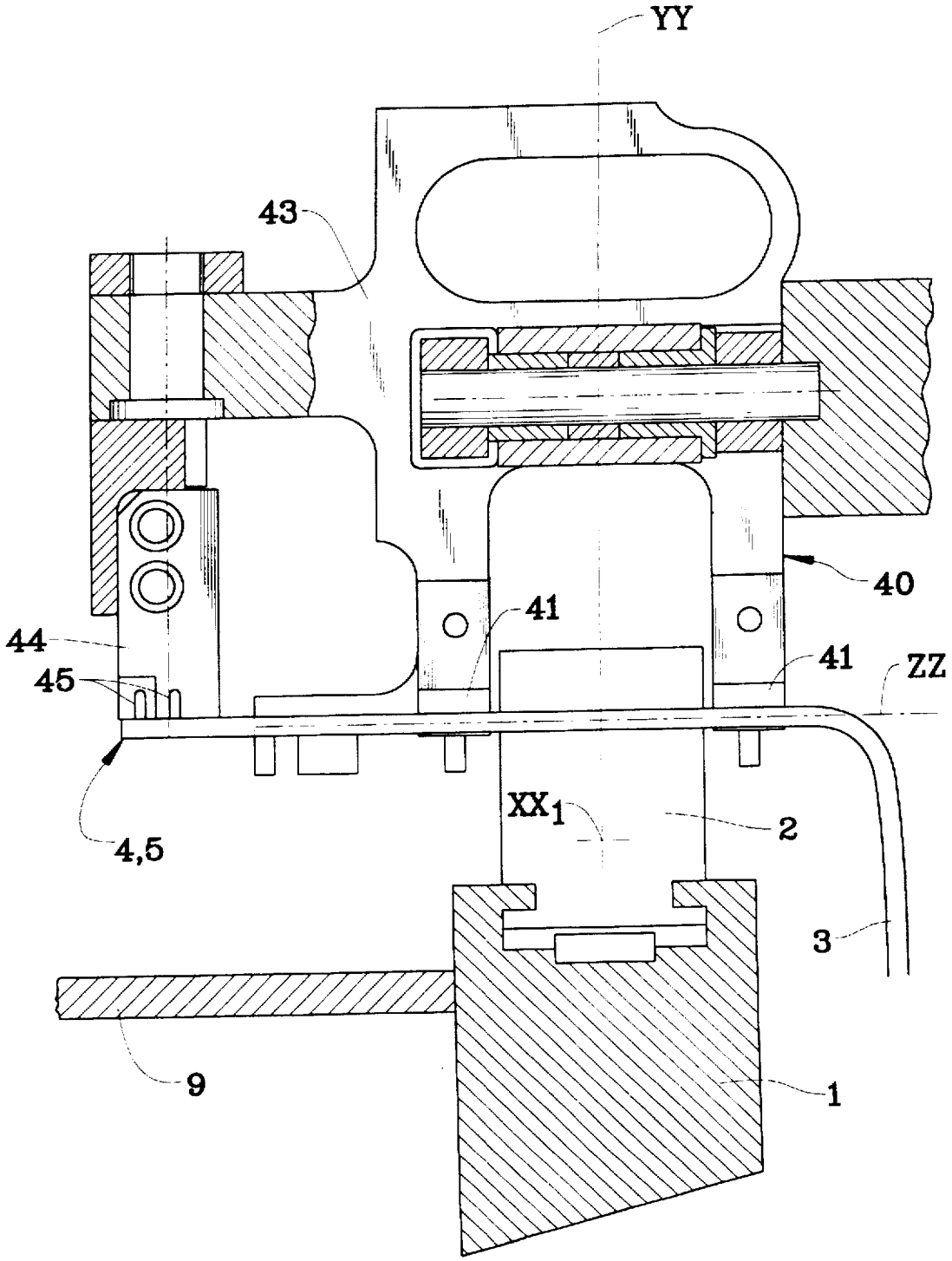
FIG. 6 is a section view on a vertical plane through a particular embodiment of the extraction-insertion clamp, the clamp being shown in a position for extracting a wire end held by a transfer clamp that is moved by a main conveyor.

The wire end 4, 5 as shown in FIG. 6 is extracted by vertical upwards movement along the axis YY of the clamp 40 under drive from the device 42, 47 shown in FIG. 3, which movement is then followed by rotation of the entire insertion tool that is rotatable about said axis YY1 under drive from said motor 15 shown in FIGS. 1 to 3 until the position shown in FIG. 2 is reached, where upon said rotation is stopped. Insertion can then be performed by vertical downwards movement (along arrow 39 in FIG. 7) of said clamp holding said wire end in said jaws 41, the end 4, 5 of said length of wire engaging in the cavity of insulation-displacement component 18 disposed on the slideway 13.

Figure 5:
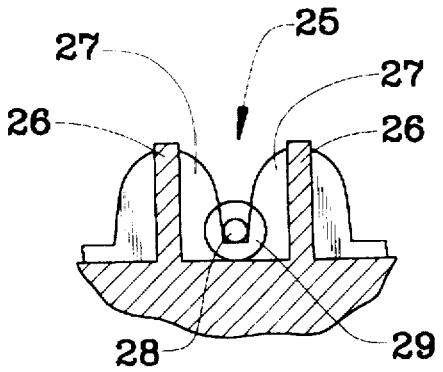
FIG. 5 is a simplified fragmentary section showing a detail of the insulation-displacement components, which components are known per-se.
Figure 7:
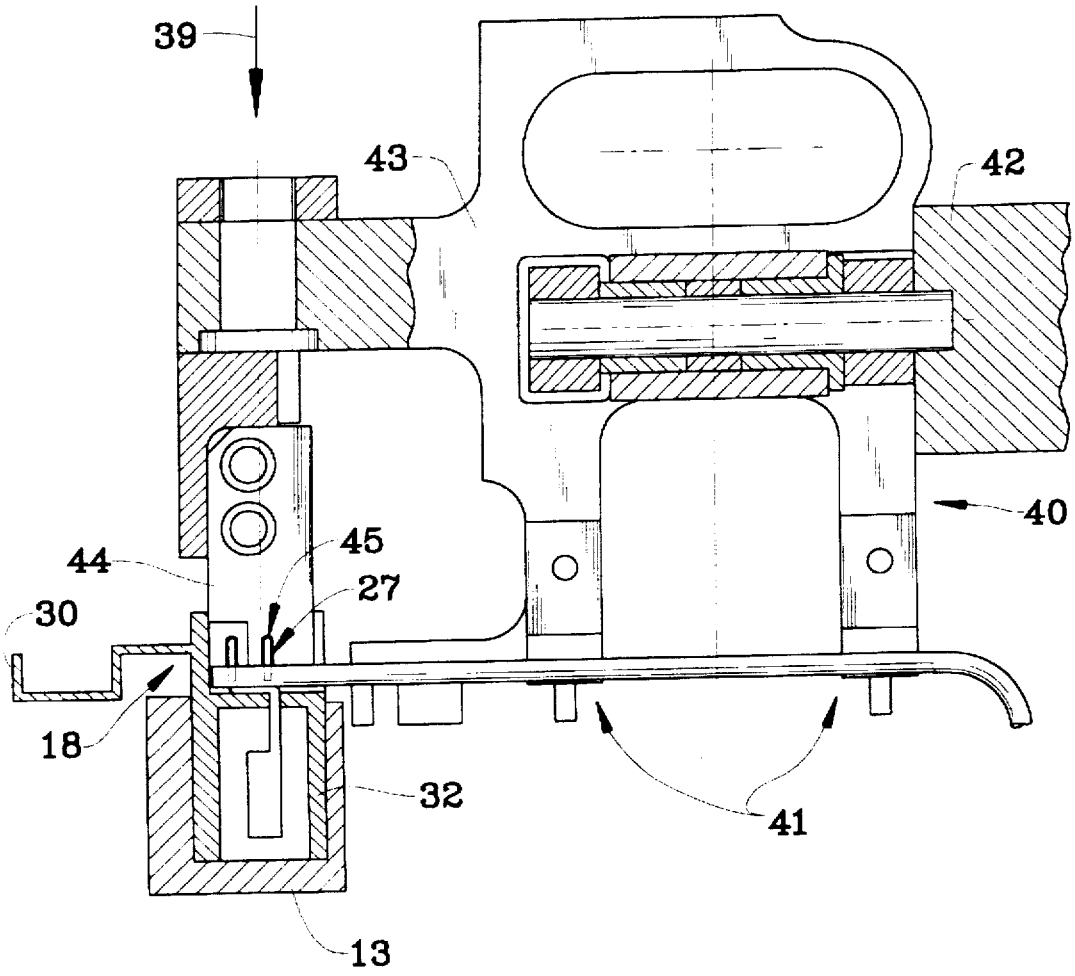
FIG. 7 is a section view on a substantially vertical plane through the same clamp as that shown in FIG. 6 but with the clamp and the insertion tool being in a position corresponding to a wire end held by said clamp being inserted into a cavity of an insulation-displacement component.

To this end, it can be seen with reference to FIGS. 7 and 5 that said notches 45 provided in the bottom portion of the punch 44 that is fixed relative to the body of said clamp 40 enable the end of the length of wire to be inserted between the blades 27 situated in each cavity 25 of the insulation-displacement component 18, which insertion of the end causes the insulating sheath 29 that surrounds the conductive core 28 of the electric wire to be cut, thereby making electrical contact possible between the core 28 of the wire and the blades 27 of the component or connector, and thus making it possible to provide an electrical connection between the wire and said connector.

As shown in FIGS. 4 and 7, it can be seen that said slideway 13 may be constituted, at least in part, by a section bar having a hollow channel 30, 31, along which it is possible to slide at least a portion of the body 32 of the component 18. The profile of said channel 31, i.e. the shape and disposition of its bottom face 36 and its side faces 37, is complementary to the profile of the bottom portion of the body 32 of the component so as to allow the component to slide with a small amount of clearance along the channel of said slideway 13.

As shown in FIG. 4, it can be seen that it is preferable to provide a toothed wheel 35 about the axis YY (which may be vertical for example), which wheel may be rotated about said axis by a drive motor 48, said wheel being provided in the insertion zone, i.e. in a portion of the slideway which is referenced 40 in FIGS. 1 and 2 and which corresponds to the portion of the slideway that faces the insertion clamp 40 when the insertion operation proper is performed, with this configuration also being visible in FIG. 3. Said wheel 35 includes teeth 38 at its periphery (or edge) suitable for meshing with non-uniformities 34 (specifically recesses) provided in one of the faces of the body 32 of the component 18 in order to move it and position it accurately, said recesses 34 of said component being spaced apart at a constant pitch 33.

As shown in FIG. 4, said insulation-displacement component includes a succession of cavities 25 that are in alignment and regularly spaced apart, each being designed to receive an electric wire end. The cavities 25 may be covered, once all of the ends have been inserted therein, by a cap 30 that fits over the top portion of said cavities.

Although the slideway shown in FIGS. 1 and 2 is placed downstream (relative to the advance direction 11 of the main conveyor) from said insertion tool carrying said insertion clamp 40, it is possible to place said slideway upstream from said insertion tool, or indeed to place a slideway on either side of said tool which is then capable of performing insertion operations on components situated on both slideways. It is also possible to mount two insertion clamps 40, each fixed to a vertical displacement drive device (47, 46, 42, see FIG. 3) in order to achieve independent displacement of each of the insertion clamps, thereby making it possible simultaneously to grasp both ends of a single piece of wire previously placed in two successive transfer clamps of the main conveyor, and then to displace both of the ends of the wire as held by the two insertion clamps simultaneously in rotation about the axis YY, so as to insert them simultaneously or successively in two cavities by performing two independent vertical translation movements, one for each of the clamps 40 mounted on its own respected moving support 42, which supports are mounted on the rotary support 17, with said disposition making it possible to process lengths of wire that are very short.

It is desirable, in particular for this purpose, and especially when the insertion tool has one clamp only, for the distance (referenced 53 in FIG. 1) between the axis XX1 of said main conveyor and the axis YY1 of rotation of said tool, and/or for the distance (referenced 50 in FIG. 2) between said axis XX1 and the centre of gravity of the insertion zone to be small. The distance (referenced 52 in FIG. 1) between the axis ZZ1 of said slideway and said axis YY1 should also be small (e.g. a few tens of millimetres).

I claim:

1. A machine for producing electrical harnesses, the machine comprising: a rectilinear main conveyor suitable for moving transfer clamps for transferring the ends of lengths of wire; a bench; and a loading station for loading and preparing lengths of wire; the loading station being situated on a first side of said main conveyor, and loop-forming portions of said lengths of wire being situated on a second side of said main conveyor, characterized in that the machine includes a fixed rectilinear transverse slideway substantially orthogonal to said main conveyor, which slideway forms a member for supporting components and for guiding them in translation, each of said components being provided with cavities, said machine including a device for moving and positioning said components on said slideway, and said machine including a clamp for grasping and inserting the ends of said lengths of wire into said cavities, the clamp being mounted on a support that is movable in rotation about and translation along an axis orthogonal to said main conveyor and to said slideway, the clamp being situated on said second side of said main conveyor.

2. A machine according to claim 1, in which said slideway is provided with a channel whose section is complementary in profile to the profile of a portion of a cross-section of said components.

3. A machine according to claim 1, in which said slideway extends from the first side to the second side of said main conveyor.

4. A machine according to claim 1, further including removable magazines disposed upstream of the slideway, said machine including a selector suitable for causing said magazines to move so as to bring one of said magazines into alignment with said slideway.

5. A machine according to claim 1, including a toothed wheel suitable for meshing with non-uniformities provided on a portion of the body of each of said components.

6. A machine according to claim 1, in which said slideway includes a conveyor.

7. A machine according to claim 1, in which said main conveyor and said slideway are substantially horizontal, said slideway being disposed above said main conveyor.

8. A machine according to claim 1, including a second slideway parallel to the first slideway.

9. A machine according to claim 1, in which said support for said insertion clamp further includes means for displacing said insertion clamp in a direction perpendicular to the axis of said slideway.

10. A method of producing electrical harnesses fitted with simple connectors by using a machine according to claim 1 wherein:

a type of wire is selected and paid out from a spool selected from a plurality of spools for storing electric wire;

a determined length of said selected wire is cut off in order to constitute a length of wire;

said length is placed in such a manner that both of its ends are held by two successive transfer clamps of a main conveyor, the central or middle portion of said length being situated on a second side of said main conveyor and hanging from said ends which are held by said clamps;

said transfer clamps are moved in an advance direction while still holding the wire ends;

where appropriate, as said wire ends held by said transfer clamps pass a station for processing ends, a processing operation is performed on said ends;

thereafter, an extraction and insertion clamp that is mounted to move in rotation about and translation along an axis which is orthogonal to the axis of said main conveyor and to the axis of said slideway is used to extract at least one of the ends of a length of wire;

said clamp is moved in such a manner as to cause said end held by said clamp to face a cavity in a component situated on said slideway in said insertion zone; and said insertion clamp is moved to cause said end to be inserted in a cavity of said component.

* * * * *